US007172404B2

(12) United States Patent
Braungardt et al.

(10) Patent No.: US 7,172,404 B2
(45) Date of Patent: Feb. 6, 2007

(54) MOLDING INSERT FOR MOLDING MACHINES

(75) Inventors: Rudolf Braungardt, Pechtelsgrün (DE); Erwin Schmucker, Schelklingen (DE)

(73) Assignee: Kobra Formen GmbH, Lengenfeld (DE)

( * ) Notice: Subject to any disclaimer, the term of this patent is extended or adjusted under 35 U.S.C. 154(b) by 0 days.

(21) Appl. No.: 10/524,352

(22) PCT Filed: Aug. 30, 2003

(86) PCT No.: PCT/EP03/09652

§ 371 (c)(1),
(2), (4) Date: Feb. 11, 2005

(87) PCT Pub. No.: WO2004/022294

PCT Pub. Date: Mar. 18, 2004

(65) Prior Publication Data

US 2005/0238751 A1 Oct. 27, 2005

(30) Foreign Application Priority Data

Sep. 6, 2002 (DE) ..... 102 41 238

(51) Int. Cl.
*B28B 7/10* (2006.01)

(52) U.S. Cl. ..... 425/444; 425/421; 425/431; 425/452

(58) Field of Classification Search ..... 425/255, 425/412, 413, 421, 431, 452, 444
See application file for complete search history.

(56) References Cited

U.S. PATENT DOCUMENTS

| | | | | |
|---|---|---|---|---|
| 2,532,049 | A * | 11/1950 | Wittke | 425/424 |
| 3,095,629 | A * | 7/1963 | Long | 425/356 |
| 4,545,754 | A | 10/1985 | Scheidt et al. | |
| 6,464,199 | B1 * | 10/2002 | Johnson | 249/117 |

FOREIGN PATENT DOCUMENTS

| | | |
|---|---|---|
| DE | 44 43 475 | 6/1996 |
| DE | 296 11 484 U | 9/1996 |
| DE | 197 47 770 | 5/1999 |

* cited by examiner

*Primary Examiner*—Donald Heckenberg
(74) *Attorney, Agent, or Firm*—Collard & Roe, P.C.

(57) ABSTRACT

The invention relates to the production of multi-layered concrete moulded bodies in a moulding machine comprising a moulding insert having a plurality of mould cavities. Relief structures are arranged in the lateral walls of the mould cavities and are dimensioned in such a way that projections formed on the moulded body when the filled concrete material is compacted engage in the relief structures, thereby creating sufficient retaining force for compensating the net weight of the moulded body and enabling the moulded bodied to be extracted from the mould cavities as a result of additional demoulding forces and causing elastic deformation of the projections without any material being cut off from the projections.

15 Claims, 4 Drawing Sheets

MOLDING INSERT FOR MOLDING MACHINES

CROSS REFERENCE TO RELATED APPLICATIONS

Applicants claim priority under 35 U.S.C. §119 of German Application No. 102 41 238.3 filed on Sep. 6, 2002. Applicants also claim priority under 35 U.S.C. §365 of PCT/EP2003/009652 filed on Aug. 30, 2003. The international application under PCT article 21(2) was not published in English.

BACKGROUND OF THE INVENTION

1. Field of the Invention

The invention relates to a molding insert for molding machines, for the production of compacted molded bodies.

2. The Prior Art

Such molding inserts are particularly in use devices for the production of stones molded from concrete and, in this connection, form a vibrating mold, together with a mold frame. The mold cavities of a mold insert set onto a vibrating table are filled with concrete mass and closed off at the top with pressure dies. By means of vibration excitation of the vibrating table, the concrete mass is compacted to such a great extent that the damp molded stones subsequently de-molded from the molding insert retain their shape and can be stored in intermediate storage for final drying and curing.

For such intermediate storage, a differentiation is made between:

a) Single-layer production systems, which leave the molded stones on an intermediate plates located between the vibrating table and the molding insert even during the vibration process, lift the molding insert up from the intermediate plate during de-molding, and which use a layer of molded stones together with the intermediate plate for intermediate storage, whereby typically, several units with one plate and one layer of molded stones each are stacked on top of one another.

b) Multi-layer production systems, in which several layers of molded stones are laid on top of one another without intermediate plates. For this purpose, the molded stones in the mold cavities must be held in the mold cavities even after the molding insert is lifted up from the vibrating table or, if applicable, from an intermediate plate, and pressed out of the mold cavities to deposit them.

SUMMARY OF THE INVENTION

The invention is based on the task of indicating an advantageous molding insert for multi-layer production.

The invention provides a molding insert having one or more mold cavities for use in molding machines, for the production of compacted molded bodies, particularly concrete molded stones, and their deposit in a multi-layer arrangement. The device contains pressure devices for pushing the compacted molded bodies out of the molding insert, in the downward direction. The walls of the mold cavity have relief structures, with depressions that possess holding flanks that drop down towards the center of the mold cavity. The relief is coordinated with the volume of the mold cavity and the material of the molded body, in such a manner that on the one hand, the inherent weight of the molded body is not sufficient to de-mold the material of the molded body from the mold cavity and, on the other hand, the molded body can be de-molded from the mold cavity, under the influence of the pressure device, without shearing off the projections that are located in depressions of the relief, on lateral surfaces of the molded body. Discussed below are advantageous embodiments and further developments of the invention.

In the case of the molding insert according to the invention, advantage is taken of the fact, for one thing, that the compacted molded bodies are supposed to be stable in shape, in and of themselves, in accordance with the goal of compaction, and therefore can be held in the molding insert with a positive lock, counter to the inherent weight force (as well as any acceleration forces or inertial forces that might occur). For another thing, the property of compacted concrete molded bodies known from DE 44 43 475 A1 or DE 197 47 770 A1, for example, of still being elastically resilient in the damp state, is advantageously utilized. Both properties, which are actually known, are advantageously combined in such a manner that the positive-lock engagement between depressions in the relief structure in the walls of the mold cavity and the projections on lateral surfaces of the molded body that are produced in these depressions during compaction are sized to be so large that on the one hand, a force that exceeds the inherent weight of the molded body (which results from the volume and the material), downward, is required for de-molding the molded body, which force is applied, in simple manner, by means of a vertical movement of the molding insert relative to the pressure direction used for compaction, but on the other hand, the positive-lock engagement is limited, in such a manner that the projections on the lateral walls of the molded body which engage in the depressions of the relief structure are not sheared off during the forced de-molding, and/or that no residues that go significantly beyond the normal measure of conventional molding inserts having flat walls remain in the relief structure. The relief structure particularly also allows the use of molding inserts having hardened walls, with a very slight material adhesion to the concrete mass of the molded body.

The relief has holding flanks that are inclined downward at a slant towards the interior of the mold cavity, as support surfaces on which projections of the lateral surfaces of the compacted molded body support themselves. The angle of these holding flanks from the vertical is preferably at most 30°, so that during the forced de-molding, sliding of the projections along the holding flanks takes place, with a gradual lateral deformation of the material of the molded body, preferably within the range of elastic deformation. A slight remaining deformation of the projections on the lateral surfaces is not critical, since the function of these projections, that of holding the molded body in the molding insert counter to its weight force, is eliminated after de-molding.

The inherent weight of the molded body depends not only on the volume but also on the density of the material, but this typically does not vary significantly, so that the weight of the compacted molded body can essentially be considered to be known. In the estimate of the required holding force, it must also be taken into consideration that in the case of multi-layer production, after compaction of the molding insert, movement of the compacted molded bodies takes place vertically and possibly also horizontally, and that in this connection, acceleration forces occur, which are not yet allowed to result in the molded bodies falling out of the molding insert. With regard to the deformability of the damp molded body after compaction, greater variations can occur, depending on the degree of compaction, and this can have an effect on the holding force and the maximal elastic deformability. It is therefore advantageous that the depth of the relief structure can be designed for great rigidity with low elastic deformability, and the entire holding surface of all holding flanks can be designed for low rigidity, with easy deformability of the compacted, damp molded body, within the scope of the variations to be expected.

A depth of maximally 1.5 mm, particularly of maximally 0.8 mm, proves to be advantageous for the relief depth of the relief structure. The minimal depth is advantageously 0.2 mm. In order to obtain a sufficient holding force over the sum of the holding surfaces of all the holding flanks, the cumulative expanse of all the holding flanks in the horizontal direction, parallel to the walls, is at least equal to the circumference of the molded body, preferably at least equal to twice this circumference. It is advantageous that the relief structure can have several holding flanks, one after the other, in the vertical direction, which are separated by segments of the relief structure that do not apply any holding forces.

In an advantageous embodiment, the relief structure contains concave and/or convex regions having a radius of curvature that is relatively great, preferably at least five times as great, as compared with the relief depth. Concave and/or convex regions can form a wave-like profile, following directly one after another.

It is advantageous that the relief structure can contain elongated, preferably essentially horizontal grooves, particularly grooves having a constant cross-section. In the case of polygonal footprints, such grooves advantageously extend over more than half the distance between two adjacent corners. The holding flanks of the relief structure are preferably present at wall surfaces that lie opposite one another with reference to the volume center of gravity of the mold cavity, and/or in an arrangement of rotational symmetry about a vertical center axis of the mold cavity.

The concepts of the depressions in the relief structure and projections on the lateral walls can also be used interchangeably, in principle, but relate in evident manner to a preferred embodiment in which the mold cavity, preferably in the upper edge region, has at least one prismatic segment having vertical wall surfaces without any relief structure, and the relief structure recedes behind the continuation surfaces of this prismatic segment.

It is advantageous if the relief structure is predominantly, particularly by at least 60%, formed in the lower half of the vertical expanse of the mold cavity. According to a further development, it can be provided that the clear cross-section of the mold cavity widens in the downward direction, in the progression of the relief structure.

BRIEF DESCRIPTION OF THE DRAWINGS

The invention is explained in detail below, on the basis of preferred exemplary embodiments, making reference to the drawings. These show.

DETAILED DESCRIPTION OF PREFERRED EMBODIMENTS

Figure 1:
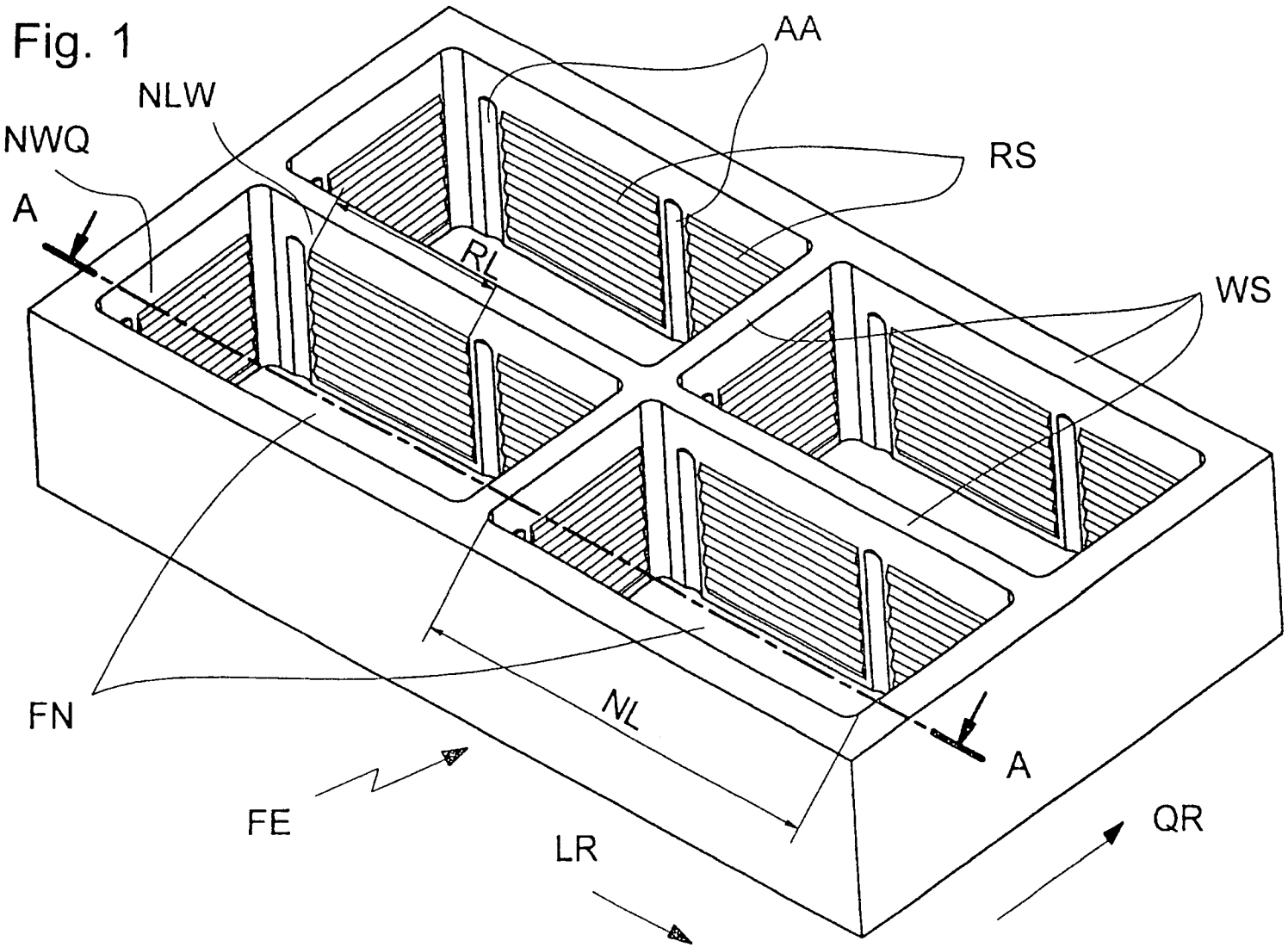
FIG. 1 a slanted view from above, into a molding insert.

A molding insert or a detail of such a molding insert FE, having several mold cavities FN, is shown in FIG. 1, with the viewing direction being from above, at a slant, into the mold cavities. The mold cavities are approximately rectangular in the example shown, and are delimited by lateral walls or partitions WS. The mold cavities are open towards the top, so that non-compacted concrete mass can be filled into them, and pressure plates of a pressure device, which end closely with the outline of the mold cavities, can be set into them, and then pressed down by a weight or pressed downward into the mold cavities in some other manner. In operation, the molding insert is set onto a vibrating table, if necessary with the interposition of an intermediate plate, and pressed downward by means of a mold frame that is not shown in the drawing. The vibrating table is excited to produce shaking vibrations by means of shock vibration or unbalance vibration, which vibrations are transferred to the concrete material that has been filled in, and compact the concrete material, within a short period of time, under the effect of the stress produced by the pressure device, to such an extent that the molded stones produced thereby, while still damp, are stable in shape.

In the case of multi-layer production, the molding insert is set onto a deposit area, for example a pallet as the first layer, or onto layers that already exist, after the compaction process has been completed, while maintaining the relative position of the molding insert and the pressure device. In this connection, either the pallet can be moved underneath the molding insert, in place of the vibrating table, or the molding insert plus pressure plates can be moved sideways over the pallet. By means of lifting the molding insert, the molded stones are pressed out of the mold cavities, in the downward direction, by means of the pressure plates of the pressure device, which are not lifted, and deposited on the deposit area or on a layer of molded stones that already exists, for drying and curing.

In the case of the molding insert drawn in FIG. 1, it is evident that the wall surfaces of the walls WS that delimit the mold cavities are provided with relief structures RS, which are located, in the example shown, both on wall surfaces NWL that run in the longitudinal direction LR, and on wall surfaces NWQ that run in the crosswise direction QR. In the preferred embodiment shown, the relief structures have the shape of elongated grooves that run horizontally, which claim the predominant part of the wall surface in the horizontal direction, if necessary with interruptions. In the vertical direction, several such horizontal grooves follow one another. In the example shown, the relief structures RS extend over more than half the height of the lateral wall surfaces. Additionally, depressions AA are provided in the lateral wall surfaces, to form spacers at the lateral surfaces of molded stones.

Figure 2:
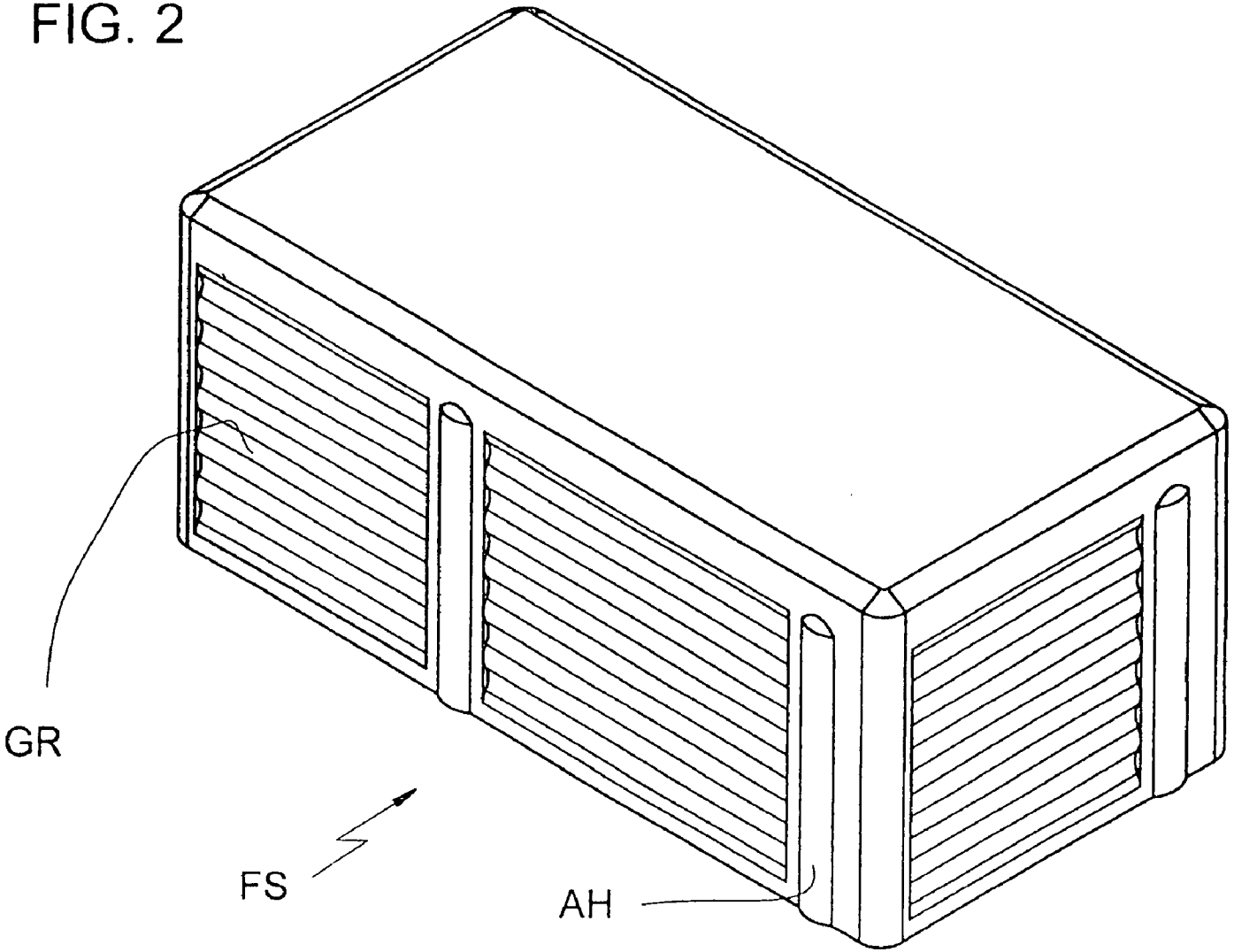
FIG. 2 a molded stone produced using the molding insert according to FIG. 1, FIG. 3 a cross-sectional view along A—A of FIG. 1, FIG. 4 an enlarged detail of FIG. 3, FIG. 5 a detail corresponding to FIG. 4, with an alternative relief shape, FIG. 6 a view corresponding to FIG. 3, with a raised relief.

FIG. 2 shows a slanted view of a concrete molded stone produced in a mold cavity FN of the molding insert FE according to FIG. 1; on its lateral surfaces, both spacers AH and counter-relief structures GR have been formed as complementary structures to the relief structures RS and the recesses AA in the wall surfaces NWL, NWQ of the mold cavity. The edges at the transition from the lateral wall surfaces to the cover surface of the concrete molded stone according to FIG. 2 are beveled, by means of known shaping of the pressure plates used.

Figure 3:
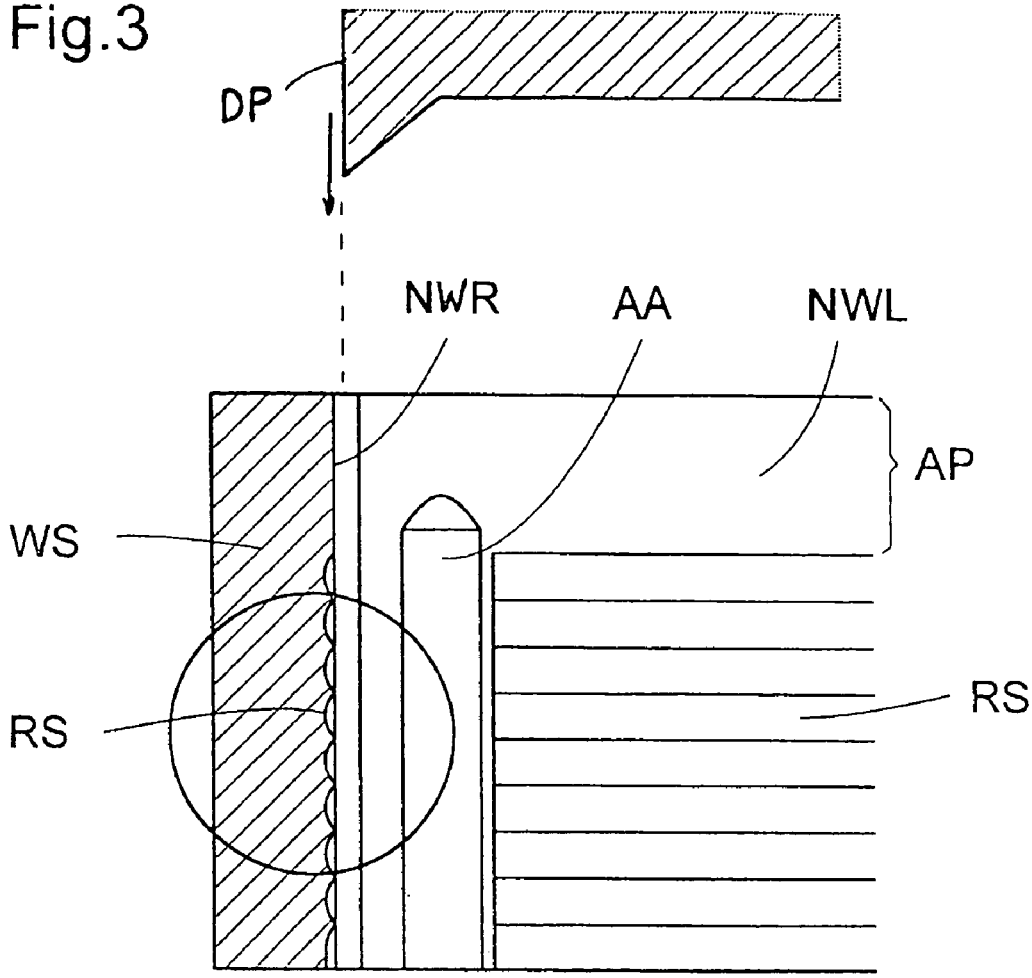

FIG. 3 shows a detail of a horizontal view into a mold cavity cut open along A—A of FIG. 1, with a vertical cutting plane. The relief structure RS is predominantly located in the lower half of the edge surface NWL and takes up more than half the height of the wall surface, in the example shown. In the horizontal direction, the relief structure is interrupted by a recess AA for a spacer. The two partial structures each have the length RL, whereby the entire lengthwise expanse of the relief structure, at 2RL, is preferably greater than half of the longitudinal expanse NL of the mold cavity. A pressure plate DP of a pressure device, for example one to which a load is applied, is set onto the mold cavity after the latter has been filled.

Figure 4:
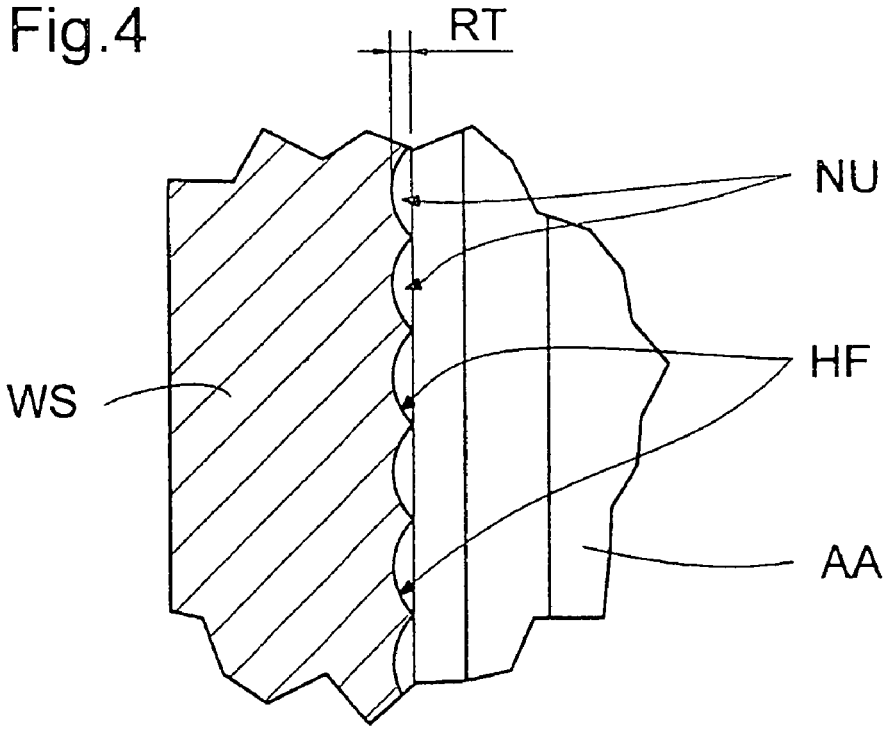

The relief structures consist of horizontal grooves NU that are arched away from the interior of the mold cavity, in concave shape, as can be seen in the enlarged detail according to FIG. 4. In the example shown, the grooves have a uniform curvature with a radius of curvature that is great relative to the relief depth RT of the relief structure. A compacted molded stone body produced in the mold cavity is connected with the relief structures by means of a positive lock with its lateral surfaces, and in this manner is held in the mold cavity even after the support of the vibrating table is removed, whereby the holding forces that absorb the weight force are applied to holding surfaces HF, which are formed by means of the lower regions of the individual grooves, in each instance, having surface tangents that run downward towards the mold cavity, whereas partial surfaces of the relief structure having a surface tangent that are vertical or are directed downward away from the mold cavity do not contribute to the holding forces. The entire holding force that becomes effective for a molded body in a mold cavity is composed of the sum of the partial forces that are applied at all of these holding surfaces HF. Because of the long expanse in the horizontal direction and the multiple sequence of the grooves of the relief structure in the vertical direction, there is a holding force that compensates the weight force of the molded body, even at a low relief depth RT.

The holding force applied by the holding surfaces HF is limited because of the fact that the molded body is still elastically deformable even after compaction, and can be pushed downward along with holding surfaces HF, with lateral compression. However, the relief structures are dimensioned in such a manner that the weight force of the molded body by itself is not sufficient to deform the molded body to such an extent that the projections of the molded body that rest in the relief structures, along the holding surfaces, overcome the relief in the downward direction. On the other hand, the relief structures are dimensioned in such a manner that a deformation of the molded body is possible, using a greater force than the inherent weight force, at least in the circumference, without shearing off the projections of the molded body that engage in the relief structures, that these projections overcome the relief structures in the downward direction, and the molded body can be pressed out of the mold cavity.

The relief depth RT is advantageously at least 1.5 mm, preferably maximally 0.8 mm, particularly maximally 0.5 mm. The minimal depth RT of the relief structures is advantageously 0.1 mm, preferably 0.2 mm, particularly 0.3 mm. In the example shown, let us assume a uniform relief depth for all the grooves, which is preferred but not necessary.

Figure 5:
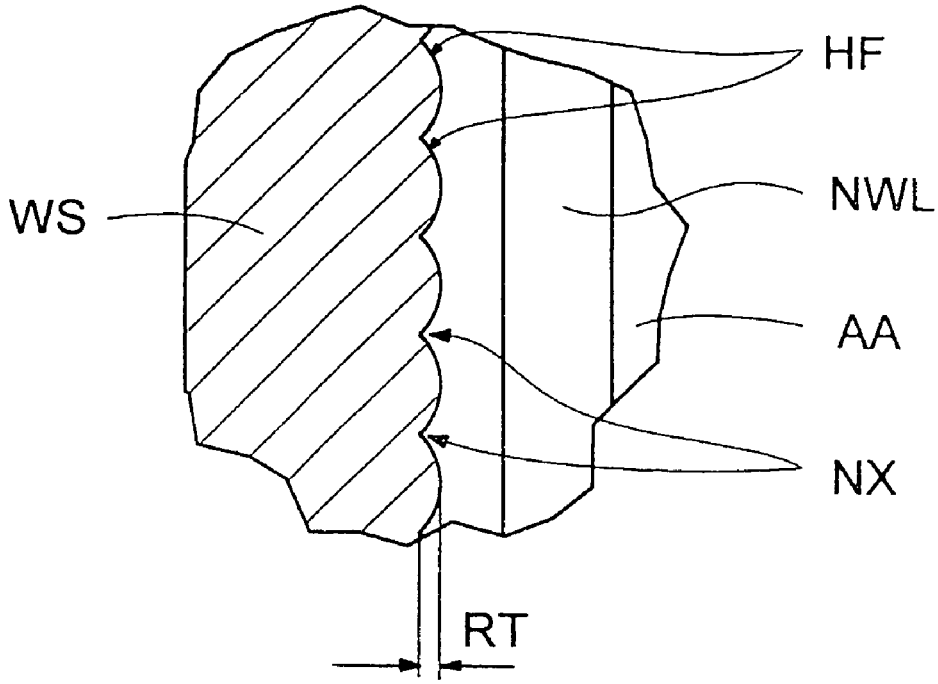

FIG. 5 shows an embodiment of a relief structure in which the relief structure shows convex regions NX towards the interior of the mold cavity. The method of effect is analogous to the relief structures according to FIG. 4.

Figure 6:
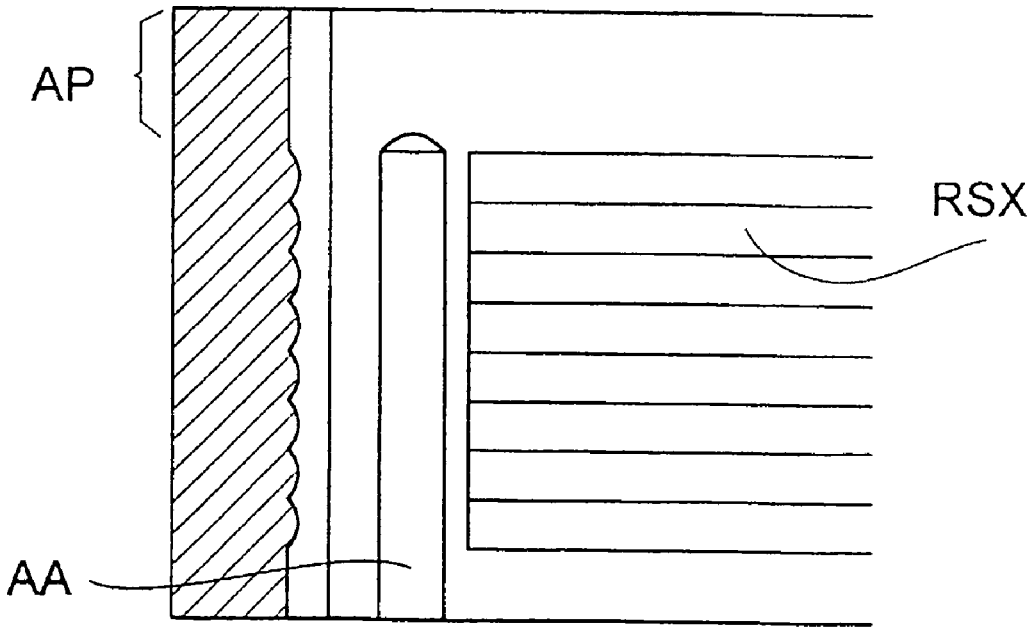

In the representations according to FIG. 1 and FIG. 3, the mold cavity has a prismatic progression in an upper region, with non-structured vertical wall surfaces and a cross-section that remains uniform in the vertical direction. In FIG. 3, the relief structure RS in the wall surface NWR is configured to be set back relative to the vertical extension of this prismatic segment AP, which has the result that the corresponding prismatic upper segment of the molded body does not experience any deformation due to the relief during de-molding in the downward direction. In another embodiment, as shown in FIG. 6, the relief structure RSX can also be raised relative to the vertical extension of the prism surfaces of the segment AP, towards the interior of the mold cavity. In the version according to FIG. 6, it should be noted that the pressure plate, which typically maintains a gap of approximately 0.5 mm towards the wall of the mold cavity, can be moved past the relief structure, if necessary, for the de-molding process.

The depth of the recesses AA for the formation of spacer elements on the lateral walls of the molded body is typically significantly greater than the relief depth RT. These recesses are open in the downward direction, so that the spacer element AH formed on the molded body does not experience any compressing deformation during de-molding of the molded body from the mold cavity.

The relief structures that are evident in FIG. 1 only on one longitudinal surface and one crosswise surface of the mold cavity, in each instance, are advantageously formed at least on two opposite wall surfaces or preferably on all the wall surfaces. In this way, the holding forces can occur uniformly, for one thing and, for another, can be distributed over a great number of holding surfaces having a low relief depth.

The characteristics that are indicated above and in the claims, as well as those that can be derived from the figures, can advantageously be implemented both individually and in different combinations. The invention is not limited to the exemplary embodiments described, but rather can be modified in many different ways, within the scope of the ability of a person skilled in the art. In particular, a plurality of possibilities of combinations of the shapes described, or other, non-linear partial structures, is possible for the shape of the relief structure. The partial structures can also be smaller and/or spatially separated to a greater extent.

The invention claimed is:

1. A molding insert for use with a molding machine for production of compacted molded bodies of material and deposit of the compacted molded bodies in a multi-layer arrangement, the compacted molded bodies being pushed via pressure devices out of the molding insert in a downward direction, said molding insert comprising at least one mold cavity having a mold cavity interior, a mold cavity volume, and a plurality of walls comprising relief structures for forming counterrelief structures on the molded body formed in the mold cavity, wherein said relief structures comprise depressions for forming projections on lateral surfaces of the molded body formed in the mold cavity, the depressions having holding flanks that are downwardly inclined toward the mold cavity interior at an angle no more than thirty degrees from the walls, the relief structures being coordinated with the mold cavity volume and the material of the molded body so that the molded body remains in the mold cavity until pushed out via a pressure device without shearing off the projections located within the depressions.

2. The molding insert as recited in claim 1, wherein the holding flanks run in strip shape and at least predominantly horizontally.

3. The molding insert as recited in claim 1, wherein the holding flanks are disposed several times in a vertical direction, following one another.

4. The molding insert as recited in claim 1, wherein the cumulative length of the holding flanks is greater than the circumference of the molded body.

5. The molding insert as recited in claim 1, wherein holding flanks are formed on at least two wall surfaces of the mold cavity that lie opposite one another, with reference to the center of gravity of the molded body.

6. The molding insert as recited in claim 1, wherein the wall of the mold cavity contains a prismatic wall segment having wall surfaces and the relief structures are set back relative to the wall surfaces of the prismatic segment.

7. The molding insert as recited in claim 1, wherein the relief structures are formed predominantly in the lower half of the vertical expanse of the walls of the mold cavity.

8. The molding insert as recited in claim 1, wherein the mold cavity has a clear cross-section that widens in the downward direction, in a vertical progression of the relief structure.

9. The molding insert as recited in claim 1, wherein the surfaces of the walls of the mold cavities are hardened.

10. The molding insert as recited in claim 4, wherein the cumulative length of the holding flanks is greater than twice the circumference of the molded body.

11. A molding insert for use with a molding machine for production of compacted molded bodies of material and deposit of the compacted molded bodies in a multi-layer arrangement, the compacted molded bodies being pushed via pressure devices out of the molding insert in a downward direction, said molding insert comprising at least one mold cavity having a mold cavity interior, a mold cavity volume, and a plurality of walls comprising relief structures for forming counterrelief structures on the molded body formed in the mold cavity, wherein said relief structures comprise depressions for forming projections on lateral surfaces of the molded body formed in the mold cavity, the depressions having a relief depth, holding flanks that are downwardly inclined toward the mold cavity interior, and concave or convex regions having a radius of curvature that is at least five time greater than the relief depth, the relief structures being coordinated with the mold cavity volume and the material of the molded body so that the molded body remains in the mold cavity until pushed out via a pressure device without shearing off the projections located within the depressions.

12. The molding insert as recited in claim 11, wherein the relief depth is less than 1.5 mm.

13. The molding insert as recited in claim 12, wherein the relief depth of the relief structures is less than 0.8 mm.

14. A molding insert for use with a molding machine for production of compacted molded bodies of material and deposit of the compacted molded bodies in a multi-layer arrangement, the compacted molded bodies being pushed via pressure devices out of the molding insert in a downward direction, said molding insert comprising at least one mold cavity having mold cavity interior, a mold cavity bottom, a mold cavity volume, and a plurality of walls comprising relief structures and spacer-forming depressions for respectively forming counterrelief structures and spacer elements on the molded body formed in the mold cavity, wherein said relief structures for forming counterrelief structures comprise depressions for forming projections on lateral surfaces of the molded body formed in the mold cavity, the depressions having a relief depth and holding flanks that are downwardly inclined toward the mold cavity interior, the relief structures being coordinated with the mold cavity volume and the material of the molded body so that the molded body remains in the mold cavity until pushed out via a pressure device without shearing off the projections located within the depressions, and wherein said spacer-forming depressions for forming spacer elements have a greater depth than the relief depth and are open toward the mold cavity bottom.

15. The molding insert as recited in claim 14, wherein the relief structure contains grooves having a concave or convex arched cross-section.

* * * * *